United States Patent [19]

Brown

[11] 3,979,794

[45] Sept. 14, 1976

[54] SNOW REMOVAL DEVICE

[75] Inventor: George M. Brown, Queens Village, N.Y.

[73] Assignee: Lawrence Peska Associates, Inc., New York, N.Y. ; a part interest

[22] Filed: Mar. 24, 1975

[21] Appl. No.: 561,643

[52] U.S. Cl. ..... 37/12; 37/5; 126/343.5 R; 214/78; 214/302

[51] Int. Cl.[2] ..... E01H 5/10; E01H 5/00

[58] Field of Search ..... 37/5, 12, 103; 126/343.5 R; 214/78, 302, 653

[56] References Cited

UNITED STATES PATENTS

| | | | |
|---|---|---|---|
| 281,752 | 7/1883 | Church | 37/12 X |
| 974,306 | 11/1910 | Strauss | 37/12 |
| 1,570,377 | 1/1926 | Dunkle | 37/12 X |
| 2,599,098 | 6/1952 | Flynn | 37/12 X |
| 2,926,796 | 3/1960 | Martinson | 214/78 X |
| 2,979,215 | 4/1961 | Brisson | 214/78 |
| 3,106,792 | 10/1963 | Park | 37/12 |
| 3,450,288 | 6/1969 | Walsh | 214/653 X |
| 3,606,047 | 9/1971 | Schaeff | 37/103 X |
| 3,765,554 | 10/1973 | Morrison | 214/302 |

FOREIGN PATENTS OR APPLICATIONS

| | | | |
|---|---|---|---|
| 2,049,553 | 4/1972 | Germany | 37/12 |

*Primary Examiner*—Edgar S. Burr
*Assistant Examiner*—Steven A. Bratlie

[57] ABSTRACT

This disclosure pertains to a vehicular snow removal device which encloses a quantity of snow and ice into an openable container equipped with steam jackets, permitting the snow to be heated by the steam supplied to the jackets by a steam generating system mounted on the vehicle. While the melting process takes place the water produced thereby is pumped into a water receiving tank mounted on the vehicle. Hydraulic positioning devices move the container from the snow enclosing position to a position directly over the water tank where the container can be opened and any unmelted snow and ice remaining can be dropped into a hopper communicating to the top of the water tank. A cylinder provides end support to the vehicle prohibiting tilting due to the increased weight of the snow and ice in the cantilever supported container.

2 Claims, 4 Drawing Figures

SNOW REMOVAL DEVICE

BACKGROUND OF THE INVENTION

1. The Field of the Invention

This invention relates to a snow removal device affixed to a vehicle carrying a water tank, a steam generating system and a container which gathers in snow and ice, melts the snow and ice contained therein while transporting the container to a dump position over said tank. The accumulated water is used by the steam generating system and when sufficient amounts of water are stored in the tank the vehicle is allowed to discharge the stored water into sewers or other removal vehicles.

2. Description of the Prior Art

Existing snow removal vehicles have the general design wherein the snow is transported in its solid state, unheated to various melting mechanisms mounted to the vehicle. Many difficulties are encountered by the snow transport mechanisms as rocks and other hard objects tend to break the mechanism. Since the snow is transported in the cold state, from the pickup point to the melting apparatus, the entire melting cycle is forced to take place during the period that the snow and ice is in the melting mechanism. Thus protracted periods of time are required between successive dumping of snow in the melter or by the low pickup rates that are employed by those devices that deliver a constant stream of snow and ice to the melter.

SUMMARY OF THE INVENTION

The instant novel snow removal device starts heating the snow and ice upon gathering the snow into a container. While the container is being transported towards the water tank, which is capable of melting any snow as yet not melted, initial heating and melting takes place. The water tank is heated by a steam generating system which also supplies steam to the container. A vehicle is used to transport the container, water tank, steam generating system and associated hydraulically operated devices to open and close the container, transport the container from the snow gathering position to a dumping position over the water tank or to other selected dumping positions.

A primary object of the instant invention is to provide a rapid means to remove and melt snow and ice.

Another object is to provide a device sensibly insensitive to encountering rocks, stones and other hard objects while gathering in the snow and ice to be melted.

Still another object is to provide a device capable of melting the snow and ice while transporting the snow and ice to a dumping location.

A further object is to provide a device capable of dumping partially or fully melted snow and ice to either another vehicle or into a sewer or into a self-contained water storage tank.

Another object is to provide a vehicle capable of gathering snow and ice from tall drifts or mounts while parked in a stationary location.

Still another object is to provide a portable steam generating system which can be used for purposes other than snow and ice removal and melting.

These objects, as well as other objects, of this invention will become readily apparent after reading the following description of the accompanying drawing.

DESCRIPTION OF THE PREFERRED EMBODIMENT

The structure and method of fabrication of the present invention is applicable to a snow removal device which captures large quantities of snow and ice and starts to heat and melt the snow and ice during the time immediately following the capture of the snow and ice and throughout the time period used to transport the enclosing container from the capture position to a selected dumping position.

Figure 1:
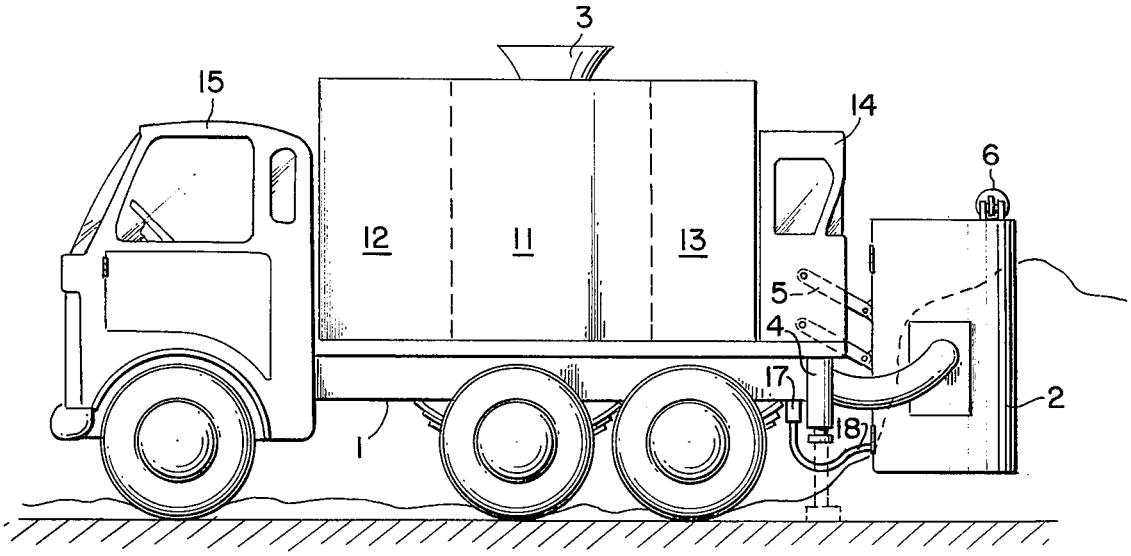
FIG. 1 is a side elevation view of the snow removal vehicle.

Now referring to the figures, and more particularly to the embodiment illustrated in FIG. 1 showing a snow removal vehicle 1 upon which is mounted a snow capturing container 2. The vehicle also supports a water tank 11 which can be supplied with snow and ice by the hopper 3 fastened to an upper opening in the tank. The steam generating chamber 13 supplies live steam to container 2 and further provides selected quantities of heat to the water tank. The container is hinged vertically along its entire height on the side of the container nearest the vehicle. Hydraulic mechanisms 5 provide raising and lowering capabilities to the container in the vertical direction as shown and also can lift up and swing the container over the opening in the hopper 3 while maintaining the container on the same vertical axis shown. Jacking cylinder 4 provides front to back stability to the vehicle while a heavy load of ice and snow is being captured and lifted up for subsequent dumping. Cab 14 is used to house all the hydraulic control devices required to open and close the container and to lift the container into a selected dumping position. An operator seated within cab 14 is capable of operating the container and heating controls during any period of time including moving of the vehicle from one location to another. Cab 15 is the conventional driver's cab. Chamber 12 houses hydraulic pumping and controlling mechanisms.

A pump 17 communicates melted water from the bottom of the container utilizing hose 18 therefor, to the water tank 11 throughout the closed cycle of the container. Suitable indicating and control devices are affixed within cab 14 so that the operator within can control the amount of steam induced into the container, the temperature of the water in the water tank, and fully control the positions of the container at all times.

Figure 2:
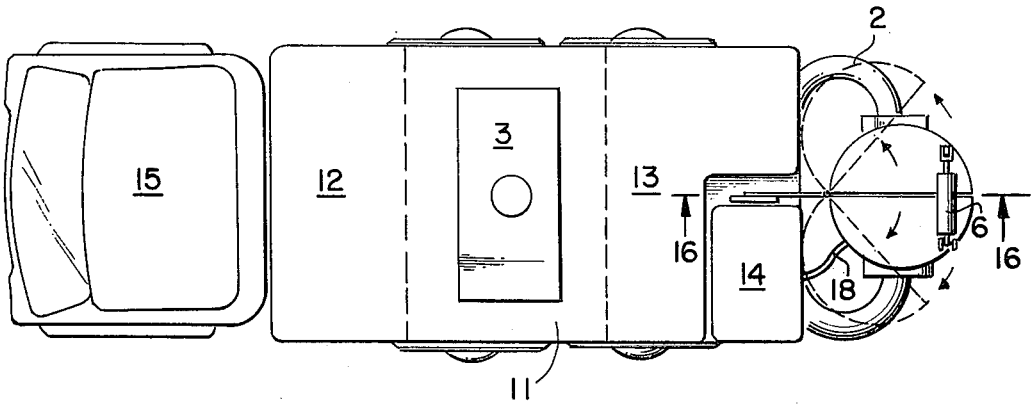
FIG. 2 is a plan view of the snow removal vehicle shown in FIG. 1.

FIG. 2 illustrates the container in an open position with hydraulic opening and closing cylinder 6 affixed to the container at the open jaws thereof.

Figure 3:
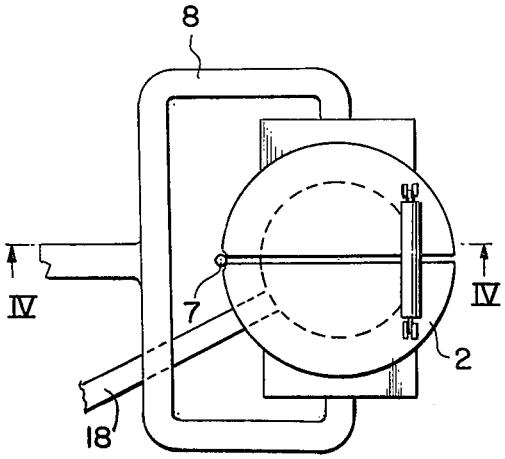
FIG. 3 is a fragmentary plan view of the container shown in FIGS. 1 and 2.

FIG. 3 shows the container hinge pivot at point 7 and flexible tubing 8 used to transmit the steam from the steam generator 13 to the container 2.

Figure 4:
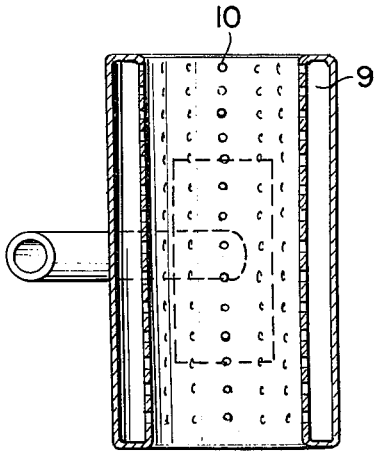
FIG. 4 is a cross sectional elevational view taken through lines 16—16 in FIG. 3 as viewed in the direction of arrows 16—16 showing a cross section of the container.

FIG. 4 illustrates the container in cut away fashion and depicts the steam jackets 9 surrounding the inner walls of the container. Holes 10 communicate the live steam within the jacket 9 to the interior of the container.

One of the advantages of the novel snow removal device disclosed herein is the speed in which the snow and ice is melted upon pickup by the capturing container.

A further advantage lies in the rugged construction of the pickup container such that rocks and other extraneous matter will not destroy any part of the mechanisms of the device.

Another advantage is in the continued heating process while the container is being brought to a selected dumping position or location.

Still another advantage lies in the ability of the snow removal device to transport fully melted or partially melted ice and snow to selected sites such as the water tank which is an integral part of the device, external sewers or other vehicles stationed nearby.

A further advantage lies in the utility of the device when the container is removed so that a portable steam generating system is provided for other tasks such as cleaning, melting and the like.

Another advantage is obtained in that snow and ice can be gathered and effectively melted while the vehicle is in a parked or stationary location thus permitting tall mounds of ice and snow to be removed in relative safety and at a low cost.

Thus, there is disclosed in the above description and in the drawings, embodiments of the invention which fully and effectively accomplish the objects thereof. However, it will be apparent to those skilled in the art, how to make variations and modifications to the instant invention. Therefore, this invention is to be limited not by the specific disclosure herein, but only by the appended claims.

The embodiments of the invention in which an exclusive privilege or property is claimed are defined as follows:

1. A snow removal device comprising a vehicle supporting a steam generating means, a water tank having an upwardly positioned opening to receive snow and/or ice and/or water, a water pumping means, and a pivotably mounted snow handling container; said snow handling container comprising a pair of elongated right and left hand semi-cylindrical chambers pivotably connected together by longitudinal hinge means along a vertical longitudinal hinge axis, each chamber being formed with an exterior wall and an interior wall connected by opposite end walls, each chamber further including a half circular top wall portion and a half circular bottom wall portion, and hydraulically operated means to pivot said chambers about said longitudinal hinge means from an open position in which to receive snow to a closed mating position forming an enclosed hollow cylinder in which to completely enclose, transport, and/or melt the received snow, and additional hydraulic means for selectively, pivotably positioning said snow handling container between an unloading position above the water tank opening and a lower working snow enclosing position, said hydraulic means maintaining said longitudinal hinge means of the snow handling container in a generally vertical plane at all times; said steam generating means communicating with said chambers by flexible tubing to provide steam vapor into said chambers; and said water pumping means being arranged to pump water from melted snow from the interior of the enclosed hollow cylinder into said water tank.

2. The snow removal device as claimed in claim 1 further comprising a plurality of openings in said interior wall of each of said chambers whereby steam vapor can communicate directly with the snow enclosed in the snow handling container.

* * * * *